US009481951B2

(12) United States Patent
Fegley

(10) Patent No.: US 9,481,951 B2
(45) Date of Patent: Nov. 1, 2016

(54) NEEDLE NOOK

(71) Applicant: David C. Fegley, Zionsville, PA (US)

(72) Inventor: David C. Fegley, Zionsville, PA (US)

( * ) Notice: Subject to any disclaimer, the term of this patent is extended or adjusted under 35 U.S.C. 154(b) by 678 days.

(21) Appl. No.: 13/951,166

(22) Filed: Jul. 25, 2013

(65) Prior Publication Data

US 2015/0027172 A1 Jan. 29, 2015

(51) Int. Cl.

| | |
|---|---|
| ***D04B 3/00*** | (2006.01) |
| ***D04B 3/02*** | (2006.01) |
| ***D04B 35/02*** | (2006.01) |
| *B65D 85/24* | (2006.01) |
| *D04B 3/04* | (2006.01) |

(52) U.S. Cl.

CPC ..... *D04B 3/02* (2013.01); *D04B 35/02* (2013.01); *B65D 85/24* (2013.01); *D04B 3/04* (2013.01)

(58) Field of Classification Search

CPC ..... B65D 85/67; B65D 85/24; B65H 49/00; D04B 3/00; D04B 3/02; D04B 3/04; D04B 3/06; D04B 37/00; D04B 39/00; D05B 91/12; D05B 91/06

USPC ..... 206/574, 225, 380, 383, 392; 220/230; 223/106, 107, 108, 109 R, 109 A

See application file for complete search history.

(56) References Cited

U.S. PATENT DOCUMENTS 1,372,648 A * 3/1921 Crowell ..... D04B 3/00 24/706.3
1,782,615 A * 11/1930 Hopwood ..... D05B 91/06 269/157
2,274,572 A * 2/1942 Yates ..... D04B 17/04 66/117
2,504,444 A * 4/1950 Parker ..... D04B 3/00 160/19
2,551,012 A * 5/1951 Kenah ..... 206/37
2,585,476 A * 2/1952 Lerner ..... D04B 37/00 223/107
2,591,836 A * 4/1952 Landon ..... D04B 3/02 66/117
2,628,711 A * 2/1953 Flannery ..... D04B 37/00 206/382
2,644,324 A * 7/1953 Spencer ..... D04B 3/02 206/380
2,718,131 A * 9/1955 Black ..... D04B 17/04 66/117
2,826,959 A * 3/1958 Schneider ..... D04B 3/00 116/240
2,928,534 A * 3/1960 Chiu ..... B65D 83/02 206/382
2,930,213 A * 3/1960 Sorlie ..... D04B 3/00 66/1 A
3,019,500 A * 2/1962 Duffin ..... D04B 3/00 24/561
3,052,391 A * 9/1962 Tracy ..... D04B 3/06 223/107
3,054,277 A * 9/1962 Broschard ..... D04B 3/00 242/157 R
3,084,788 A * 4/1963 Ford ..... D04B 3/00 206/383
3,352,445 A * 11/1967 Cochin ..... B65D 47/088 220/291

(Continued)

*Primary Examiner* — J. Gregory Pickett
*Assistant Examiner* — Gideon Weinerth

(57) ABSTRACT

The present invention relates to a knitting needle holder, wherein a set of knitting needles can be held in a channel of the holder while allowing for a knitting project to be held through an opening in the holder while engaged in an ongoing knitting project and having a pivot opening and magnetic closure mechanism.

6 Claims, 3 Drawing Sheets

(56) References Cited

U.S. PATENT DOCUMENTS

| | | | | | |
|---|---|---|---|---|---|
| 4,108,397 | A * | 8/1978 | Hauck | D04B 3/06 | 206/574 |
| D265,695 | S * | 8/1982 | Ciavarella | D3/18 | |
| 4,478,333 | A * | 10/1984 | Dalbo | A45F 3/48 | 206/380 |
| 4,630,730 | A * | 12/1986 | Storey | D04B 3/06 | 206/388 |
| D297,595 | S | 9/1988 | Sawai | | |
| 4,838,426 | A | 6/1989 | Dalbo | | |
| 4,846,351 | A * | 7/1989 | Gardiner | D04B 3/00 | 206/459.5 |
| 4,866,953 | A | 9/1989 | Slevin | | |
| 5,125,245 | A * | 6/1992 | Kuwabara | D04B 3/04 | 16/225 |
| 5,150,794 | A * | 9/1992 | Rooks | D04B 3/06 | 206/388 |
| 5,537,844 | A | 7/1996 | MacLean | | |
| 6,006,906 | A * | 12/1999 | Winnard | B25H 3/06 | 206/350 |
| 6,357,497 | B1 * | 3/2002 | Frase | A45C 3/00 | 150/109 |
| 6,449,987 | B1 | 9/2002 | Poole | | |
| D500,919 | S * | 1/2005 | MacKay | D3/20 | |
| 6,904,773 | B1 | 6/2005 | Cushman | | |
| 2007/0193909 | A1 * | 8/2007 | Chin | B65D 43/0202 | 206/457 |
| 2008/0105577 | A1 * | 5/2008 | Stingel | B65D 85/24 | 206/380 |
| 2012/0222978 | A1 * | 9/2012 | Sasur | B65D 85/24 | 206/380 |

* cited by examiner

NEEDLE NOOK

BACKGROUND OF THE INVENTION

The present invention relates generally to knitting needles and, more particularly, to a knitting needle holder, wherein a set of knitting needles can be held in a channel of the holder while allowing for a knitting project to be held through an opening in the holder for convenient and organized storage of needles while engaged in an ongoing knitting project.

The hobby of knitting has remained popular throughout time. Not only do many people find it relaxing and enjoyable, but the resulting clothes and products can save a great deal of money for the benefit of household budgets. The most common, if not the only tool used in knitting, is the knitting needle. Such needles are made in varying widths to produce the multitude of intricate stitches used in knitting. However, finding a way to store an ongoing project with the needles attached quickly becomes difficult.

Accordingly, there is a need for a means by which one can store, transport and organize their knitting needles while holding an ongoing knitting project in place. A search of the prior art did not disclose any patents that read directly on the claims of the instant invention; however, the following references were considered related:

U.S. Pat. No. 6,904,773 [Cushman] for "Knitting Needle and Storage Container Combination" discloses a combination knitting needle and storage container wherein the longest needle accommodates nesting of a plurality of smaller knitting needles to store a set of different sized knitting needles. Cushman does not disclose the ability to store needles that are in use for a knitting project while simultaneously holding the knitting project in place, like the present invention.

U.S. Pat. No. 6,449,987 [Poole] for "Knitting Aid" discloses a knitting aid for individuals who have the use of one hand only in order to enable them to participate in knitting with a pair of conventional knitting needles by use of a magnetic field to hold a knitting needle and means for tensioning yarn being knitted. Poole does not disclose the ability to store needles in use for a knitting project while simultaneously hold the knitting project in place, as the present invention does.

U.S. Pat. No. 5,537,844 [Maclean] for "Knitting Stitch Holder Assembly with Detachable Opposite End Retainers" discloses a knitting stitch holder with detachable end retainers to allow for the removal of stitches from either end of the stitch holder. MacLean does not disclose the ability to store needles inside a channeled box while clamping and holding an ongoing project in place when knitting needles are not in use, like the present invention.

U.S. Pat. No. 4,866,953 [Slevin] for "Support for Knitting Needles" discloses a knitting needle holder with flattened holders mounted on the ends of a base strap and knitting needles with rounded balls on the blunt ends to fit into sockets located in the knitting needle holder so that when a user sits on the strap the knitting needles will be supported in the correct knitting position. Slevin does not disclose the ability to store needles inside a channeled box while clamping and holding a knitting project in place when needles are not in use, like the present invention.

U.S. Pat. No D297,595 [Sawai] for "Knitting Needle Holder" discloses a stand to hold knitting needles but use of a plurality of apertures at the top of the stand which allows knitting needles to fit through the apertures and be held in place when knitting needles are not in use. Sawai does not disclose the ability to store knitting needles which are in use while clamping and holding an ongoing knitting project for a user, as the present invention discloses.

Consequently, there exists a need for a knitting needle holder which can hold knitting needles which are being used with an ongoing project while simultaneously holding the knitting project in place when user is not knitting.

SUMMARY OF THE INVENTION

According to the present invention there is provided a knitting needle holder designed with the knitting community in mind. The needle nook protects both the knitting work in progress and the double ended needles engaged in the knitting.

It is an object of the present invention to provide a size—specific case, having a channel to hold the needles, an opening in the case which allows the work to protrude, and a pivoting lid that protects and secures the project. The size is determined by the length of the needles.

Further still, the knitting needle holder of the present invention is manufactured in five different lengths, each sized for a specific length knitting needle. The knitting needles may range from 4" to 8" needles Yet another object of the present invention is to provide a knitting needle holder that is made from a variety of American hardwoods, such as oak, cherry or maple to name a few.

Another object of the present invention is to provide a knitting needle holder with a lid that pivots to open at a pin which is visible at the left of the knitting needle holder, and is held closed by rare earth magnets in the body and the lid, which are located on the right side of the holder. There is a slot at the front of the nook to allow the work to protrude while still held in place.

These together with other objects of the present invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
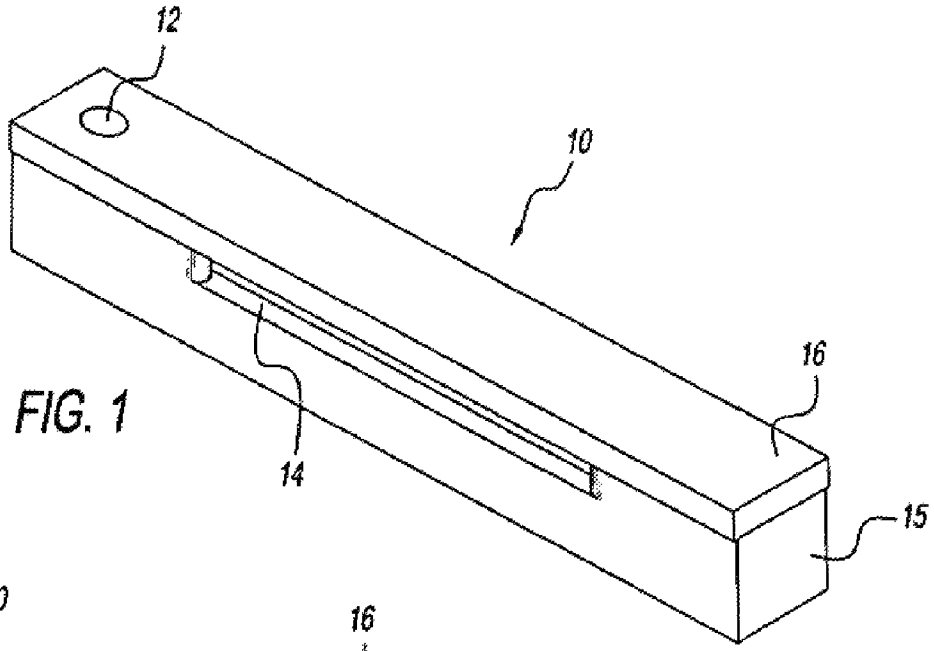
FIG. 1—is a perspective view of the knitting needle holder of the present invention for 6 inch needles, showing a front slot and a pin which allows the lid to swing or pivot open and close.

With reference now to the drawings, and in particular to FIG. 1 is shown a knitting needle holder 10 of the present invention having a front slot 14 to allow a work in progress to protrude, a body 15, a lid 16 located on top of the body 15 and held in place by a pin 12 on one end which allows the lid 16 to pivot or swing open and close and a pair of magnets 18*a*, 18*b* on the second end of the lid 16 and in the body 15 which keep the lid 16 closed when they come into contact with each other.

Figure 2:
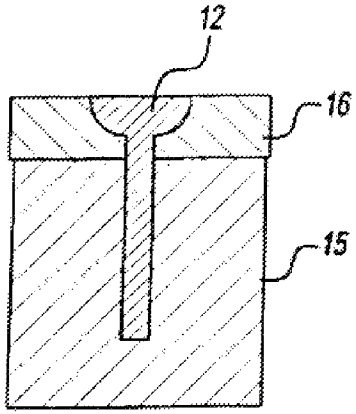
FIG. 2—is an enlarged cross section view of the pin which allows the lid of the present invention to pivot open and close.

Shown in FIG. 2 is an enlarged view of the pin 12 captured within a recess which penetrates through the lid 16 and the body 15 of the present invention 10, and allows the lid 16 of the present invention 10 to pivot or swing open and close.

Figure 3:
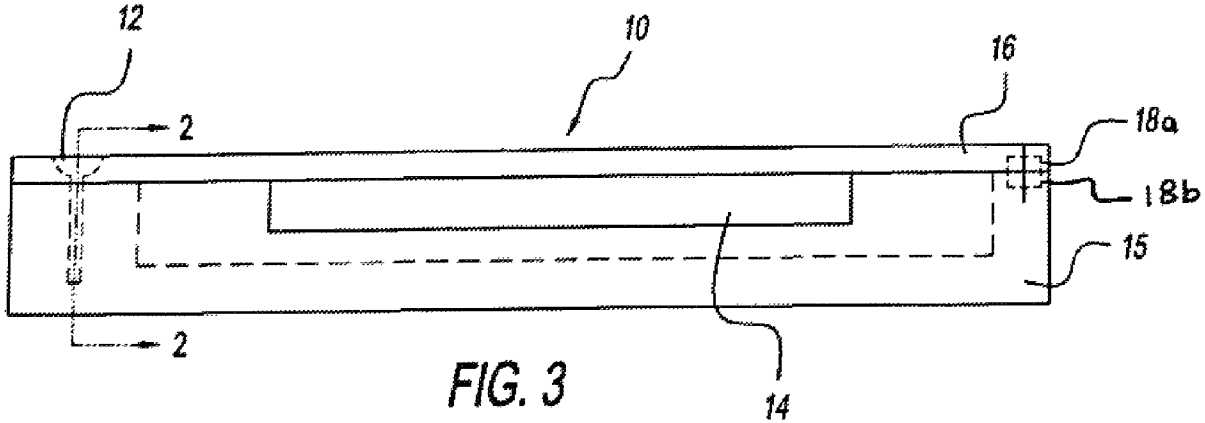
FIG. 3—is a front view of the present invention showing the lid and body assembly with the recess for the pin, the slot for the work and the recesses for the magnets for closure.

Shown in FIG. 3 is a front view of the lid 16 and body 15 of the present invention 10 showing the pin 12 at one end in its recess in the lid 16 and the body 15, the slot 14 to allow the work in progress of a user to suspend through the slot 14 outside the invention 10 and the location of the magnets 18*a*, 18*b*, at the opposite end of the lid 16 and body 15, which hold the lid 16 closed.

Figure 4A:
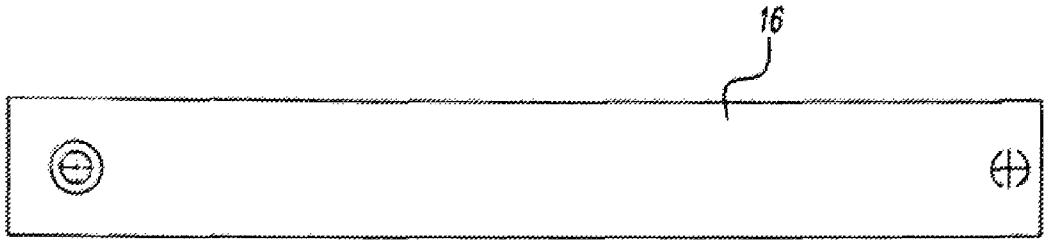
FIG. 4*a*—is a top view of the lid of the present invention.
Figure 4B:
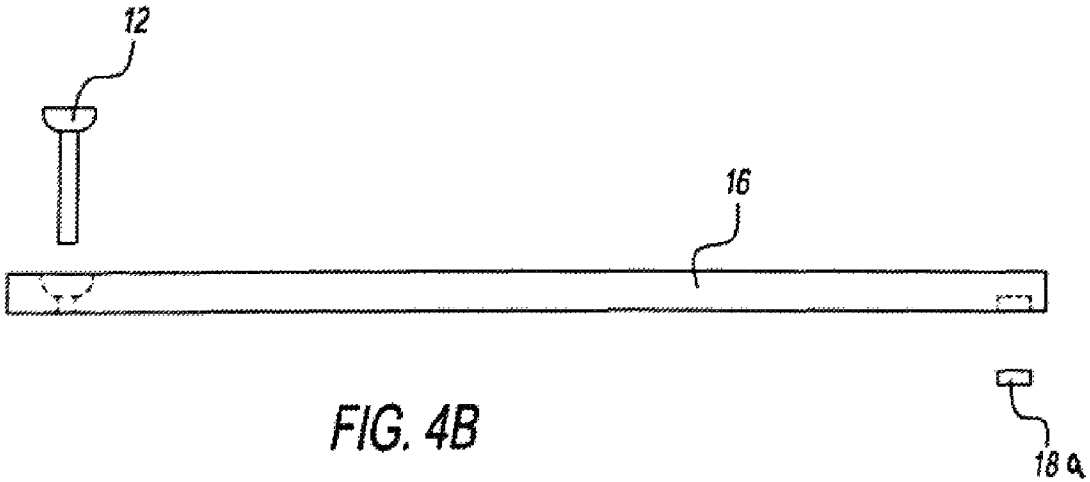
FIG. 4*b*—is a front view of the lid of the present invention showing the recess for the pin and the pin and the recess in the lid for a first magnet and the magnet.

Shown in FIG. 4*a* is a top view of the lid 16 of the present invention 10. FIG. 4*b* is a front view of the lid 16 showing the pin 12 at one end, which allows the lid 16 to pivot open and close to protect and secure the project, and the first magnet 18*a* located within the opposite end of the lid 16 for closure when it meets with the second magnet 18*b* located within the body 15.

Figure 5A:
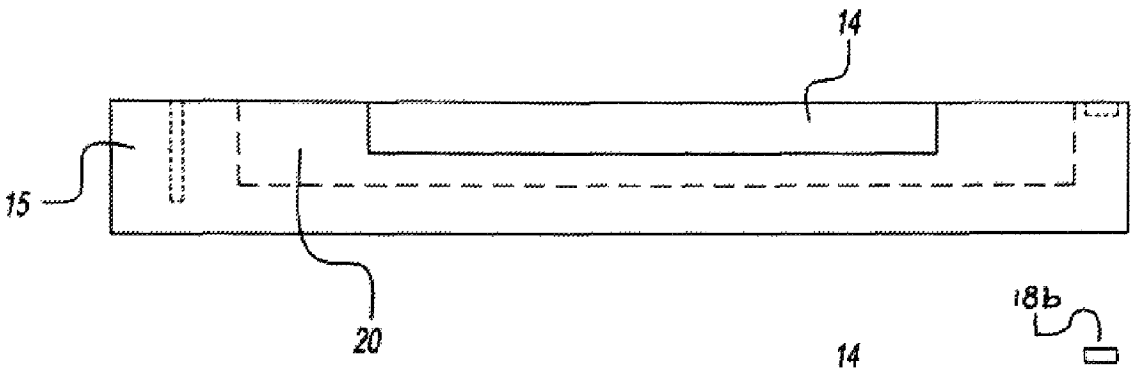
FIG. 5*a*—is a front view of the body of the present invention showing the slot for the work in progress.

FIG. 5*a* shows a front view of the body 15 of the present invention 10 showing the slot 14 for the work in progress and the recessed channel 20 for holding the knitting needles, when the needles are not in use, and the recesses for the pin at one end.

Figure 5B:
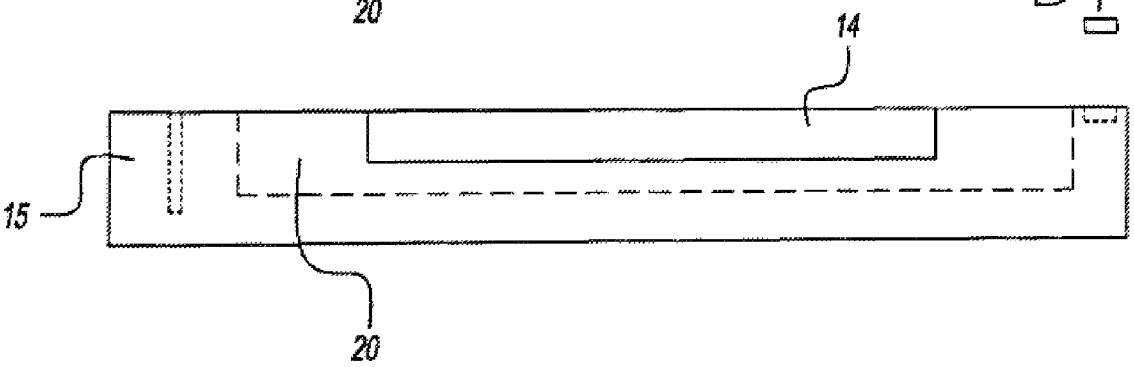
FIG. 5*b*—is a front view of the body of the present invention showing a recess for a second magnet in the body and the second magnet.

Shown in FIG. 5*b* is a front view of the body 15 showing the slot 14 for the work in progress, the recessed channel 20 for holding the knitting needles and the second magnet 18*b* located within the body 15 for closure when it comes in contact with the first magnet 18*a* located within the lid 16.

Figure 6:
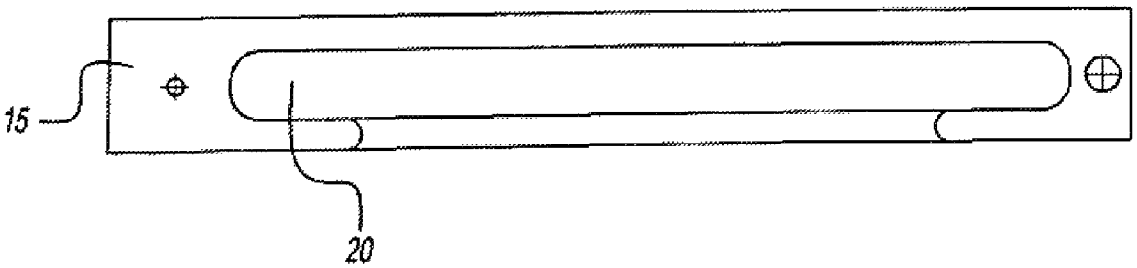
FIG. 6—is a top view of the body of the present invention showing the channel for receiving the needles and locations of the pin and second magnet.

FIG. 6 is a top view of the body 15 showing the channel portion 20 for holding the knitting needles located within the body 15.

The invention claimed is:

1. A knitting needle holder comprising:

a lid;

a body;

a pin on one end of said knitting needle holder, penetrating through said lid and captured within a recess within said body;

a recessed channel within said body capable of holding a set of knitting needles;

a slot for allowing a knitting project in progress to protrude, wherein said slot is located in the front and at the top of said body and connects the recessed chamber to the outside of said knitting needle holder, said slot being shorter than the recessed chamber, and said slot being closed off by the lid, when the lid is in a closed position; and at least two magnets located at the opposite end of the knitting needle holder from said pin, with at least one magnet captured within a recess in said lid and one magnet captured within a recess in said body capable of holding said lid closed.

2. The knitting needle holder of claim 1, wherein said lid is capable of pivotably opening by use of said pin.

3. The knitting needle holder of claim 1, wherein the channel of said holder is sized for a specific length knitting needle.

4. The knitting needle holder of claim 3, wherein said channel is sized to retain a specific size of knitting needles, wherein said knitting needle size is in a range of 4 to 8 inches.

5. The knitting needle holder of claim 1, wherein the holder can be made from a variety of American hardwoods, including oak, cherry or maple.

6. The knitting needle holder of claim 1, wherein said knitting needles are double ended needles.

* * * * *